US005934558A

United States Patent [19]

Samayoa et al.

[11] Patent Number: 5,934,558

[45] Date of Patent: Aug. 10, 1999

[54] WATER DISPLAY WITH MULTIPLE CHARACTERISTICS

[75] Inventors: Jorge Samayoa, Playa Del Rey; James Doyle, Burbank, both of Calif.

[73] Assignee: Wet Enterprises, Inc., Universal City, Calif.

[21] Appl. No.: 08/975,637

[22] Filed: Nov. 21, 1997

[51] Int. Cl.[6] ..... B05B 17/08

[52] U.S. Cl. ..... 239/20; 239/17; 137/512.1

[58] Field of Search ..... 239/12, 16–18, 239/20, 22, 99, 101; 137/512.1, 527

[56] References Cited

U.S. PATENT DOCUMENTS

| | | | |
|---|---|---|---|
| 4,844,341 | 7/1989 | Alba | 239/18 |
| 4,852,801 | 8/1989 | Fuller et al. | 239/12 |
| 4,867,199 | 9/1989 | Marx | 137/512.1 |
| 4,892,250 | 1/1990 | Fuller et al. | 239/18 |
| 4,978,066 | 12/1990 | Fuller et al. | 239/12 |
| 5,069,387 | 12/1991 | Alba | 239/18 |
| 5,301,709 | 4/1994 | Gasaway | 137/512.1 X |
| 5,480,094 | 1/1996 | Fuller et al. | 239/17 |
| 5,553,779 | 9/1996 | Fuller et al. | 239/17 |

*Primary Examiner*—Lesley D. Morris
*Attorney, Agent, or Firm*—Blakely, Sokoloff, Taylor & Zafman LLP

[57] ABSTRACT

A water display with multiple characteristics, providing a short burst of water or a steady stream of water of constant or variable height. The water display includes an interior cavity having a nozzle at the top for forming the desired stream size, and a flapper valve on the bottom through which the chamber may refill with water. A high pressure air line controllably provides high pressure air to the lower part of the chamber to force most of the water in the chamber out through the nozzle to provide a short blast of water to a height controlled by the air pressure. A second flapper valve, coupled to the chamber, allows a steady stream of water to enter the chamber and exit the nozzle from a water supply, typically a variable pressure water supply, so that a steady stream of water of variable and controllable height may be obtained. Use of the water display in plurality in coordination of the multiple modes of operation thereof provides a new visual effect. Various embodiments are described.

38 Claims, 5 Drawing Sheets

WATER DISPLAY WITH MULTIPLE CHARACTERISTICS

BACKGROUND OF THE INVENTION

1. Field of the Invention

The present invention relates to the field of water displays.

2. Prior Art

In recent years, elaborate water displays have been used as centers of attraction for public and commercial buildings, as well as at tourist destinations such as hotels and the like. These displays are generally quite dynamic, having multiple individual displays, with the operation of each being orchestrated under computer control in coordination with the others to provide time varying patterns, etc. to hold the observer's attention. The more varied the operating appearance of any one water display, the more variation and accentuation the programmer may provide. Accordingly, it is desirable to provide different operating characteristics in a single water display to increase the programmer's selection of characteristics to increase the variety of the overall visual effects which may be achieved.

In U.S. Pat. No. 4,852,801 (see also U.S. Pat. No. 4,978,066), an air-powered water display is disclosed which will eject a limited amount of water as high as hundreds of feet, depending upon the size of the display and the air pressure used. These displays have some form of one-way valve, normally a flapper valve adjacent the lowest portion thereof, to allow water to refill the chamber after the display has been fired, but to prevent the water and air from escaping from the bottom of the chamber during firing. While there is nothing separating the water in the upper part of the chamber from the high pressure air injected into the chamber adjacent the bottom thereof, only a limited amount of water will fall through the high pressure air, with most of the water being ejected through the nozzle as desired. As a result, a rather impressive display is obtained by simple control of a solenoid valve in a high pressure air line.

Also known in the prior art are water displays which shoot a single stream of water into the air. These displays can be used in large pluralities, with the pressure of the water delivered to each display being computer controlled so that the number of varying and undulating patterns which may be achieved will be substantially unlimited. An example of such displays is disclosed in U.S. Pat. No. 4,892,250. While a water stream could go to hundreds of feet in the air, the volume of water required to do this, particularly if multiple individual displays are so performing at the same time, may not be practical. Accordingly, the air-powered displays have the advantage of being operable with an air compressor of reasonable size together with a pressurized air accumulator tank to accumulate the energy for intermittent firings. Accordingly, the air-powered displays not only provide quite a different visual effect from the continuous flow displays, but also may be used for various types of accent purposes. In the present invention, these two types of displays are combined into a single assembly to provide individual displays having both capabilities, thereby increasing the variety of visual effects which may be achieved while avoiding the duplication required to obtain each individual effect from a separate individual display.

Another prior art air-powered water display for placement in a pool has a substantially vertical tubular member with a nozzle at the top thereof and a venturi restriction adjacent the bottom of the tube. The bottom of the tube itself is closed, except for a coupling to a source of pressurized air through a solenoid valve. The venturi has an opening just above the throat of the venturi which will admit water to refill the tubular member with water from the pool between firings. The venturi reduces the pressure adjacent the opening during firing so that the amount of air, if any, that passes out the opening to the pool during firing is sufficiently small so as to not effect operation of the display or cause distracting bubbles beside the display not apparently associated with the water ejected from the nozzle and falling back into the pool.

BRIEF SUMMARY OF THE INVENTION

A water display with multiple characteristics, providing a short burst of water or a steady stream of water of constant or variable height. The water display includes an interior cavity having a nozzle at the top for forming the desired stream size, and a flapper valve on the bottom through which the chamber may refill with water. A high pressure air line controllably provides high pressure air to the lower part of the chamber to force most of the water in the chamber out through the nozzle to provide a short blast of water to a height controlled by the air pressure. A second flapper valve, coupled to the chamber, allows a steady stream of water to enter the chamber and exit the nozzle from a water supply, typically a variable pressure water supply, so that a steady stream of water of variable and controllable height may be obtained. Use of the water display in plurality in coordination of the multiple modes of operation thereof provides a new visual effect. Various embodiments are described.

DETAILED DESCRIPTION OF THE INVENTION

Figure 1:
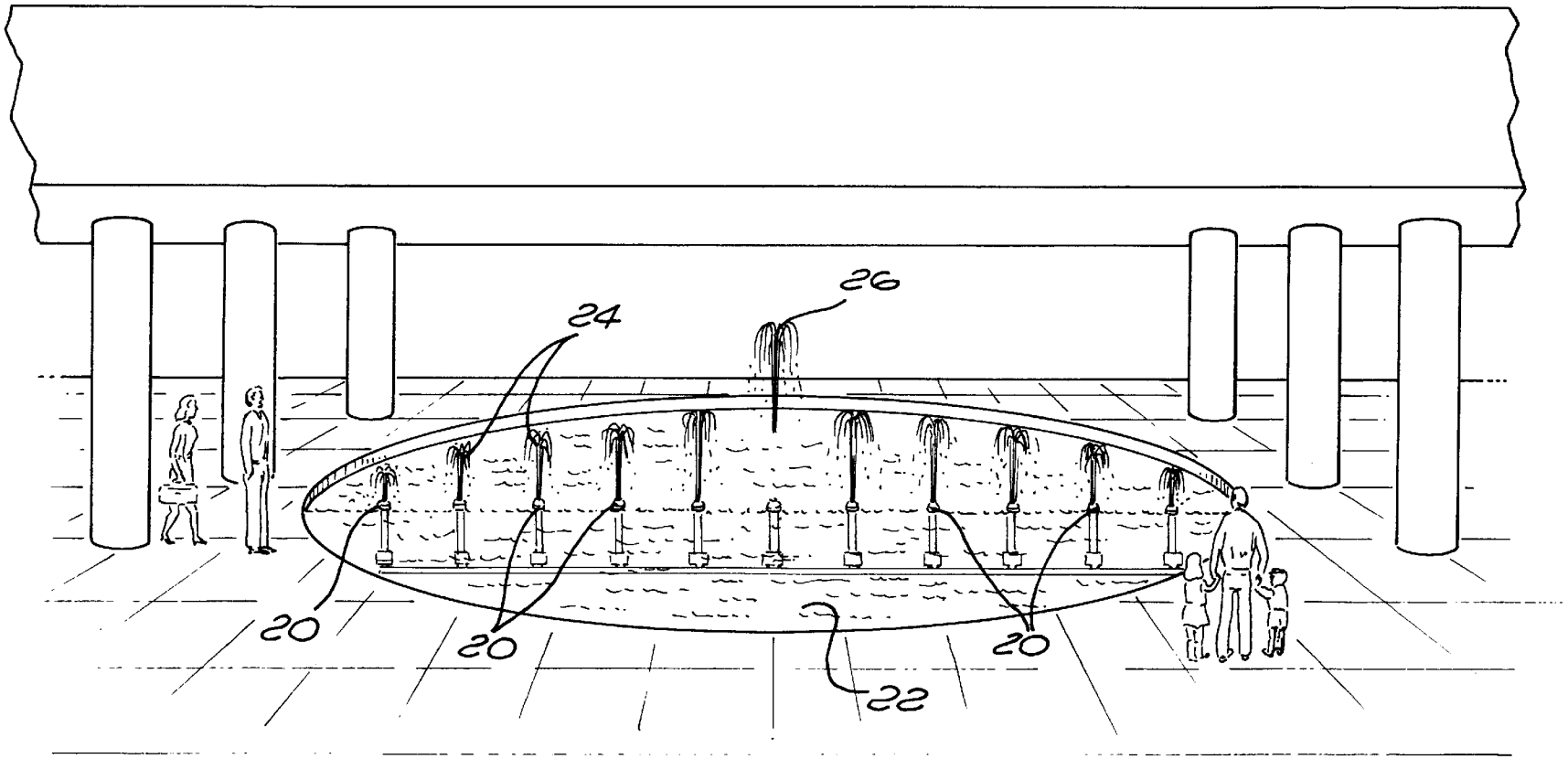
FIG. 1 is an illustration of an exemplary water display utilizing the present invention.

First referring to FIG. 1, an illustration of an exemplary water display utilizing the present invention may be seen. In this exemplary embodiment, nozzles 20 are positioned in a pattern in a pool 22 and are each separately controllable to provide at any time, either a steady stream 24 of controllable and time varying height, or to provide a relatively short in time, high energy stream of water 26 to provide accentuation and further variation of the water display. While only a linear array of nozzles are illustrated, obviously two dimensional arrays may also be used, as can nozzles of different characteristics, including nozzles which are movable vertically or alternatively permanently positioned just below the surface of the water, aerating nozzles, etc.

Figure 2:
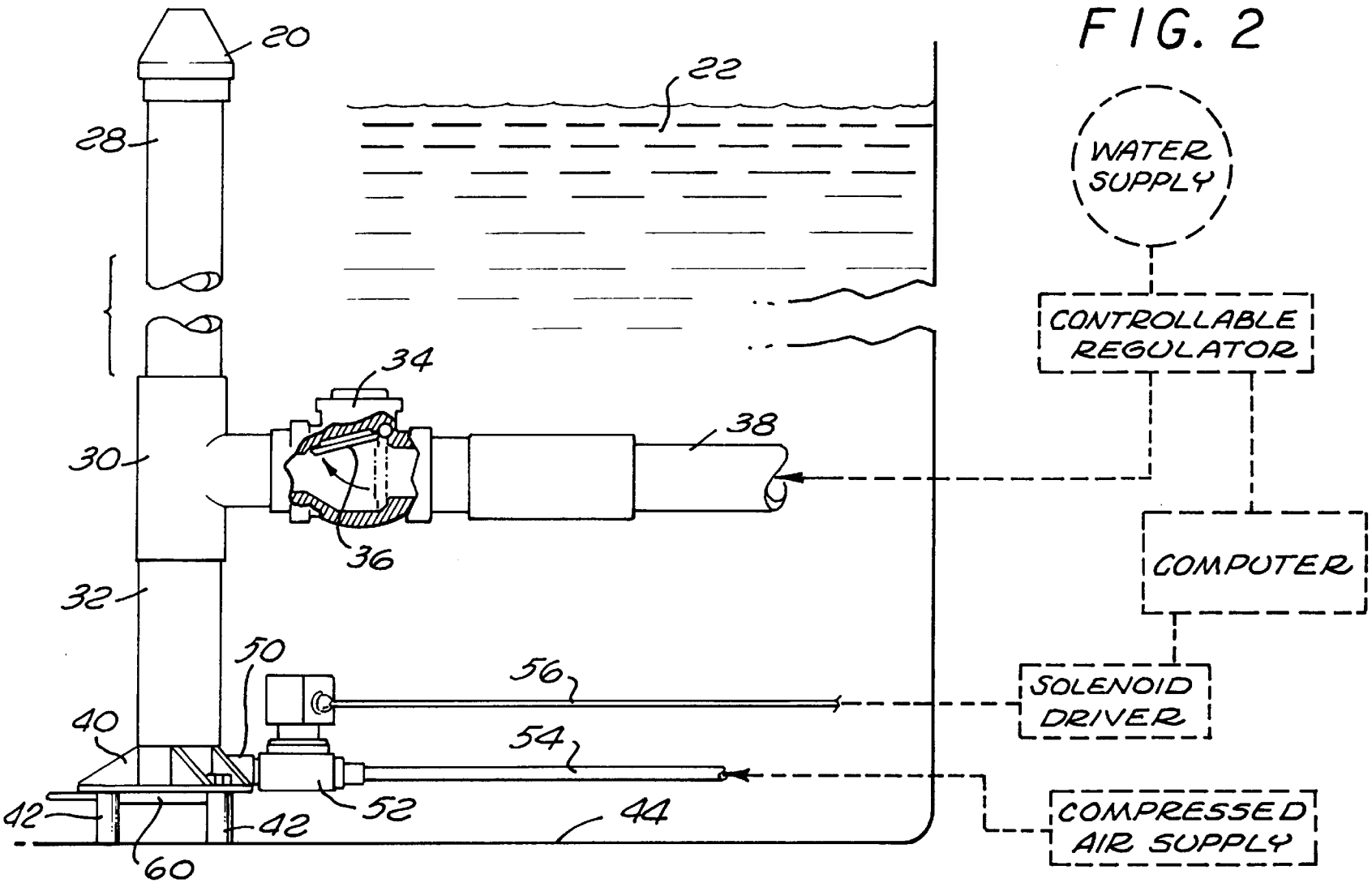
FIG. 2 illustrates some of the details of the individual water displays of the present invention and their control.

Details of the structure of the individual water displays may be seen in FIG. 2. The nozzles, in this case positioned slightly above the surface of the pool 22, are mounted on a vertical tube 28 coupled significantly below the surface of the water 22 to a tee 30, which in turn is coupled to a lower vertical tube 32. Tee 30 is also coupled to a flapper valve assembly 34 having a gravity operated flapper 36 therein allowing water to flow from a pressurized water supply through a controllable regulator and through line 38 to the flapper valve. The flapper 36, of course, provides a one way valve into the vertical tubes but blocks flow in the reverse direction, thereby avoiding reverse flow from the vertical tubing if the pressure exceeds the output pressure of the controllable regulator and/or the pressure in the pressurized water supply.

Figure 3:
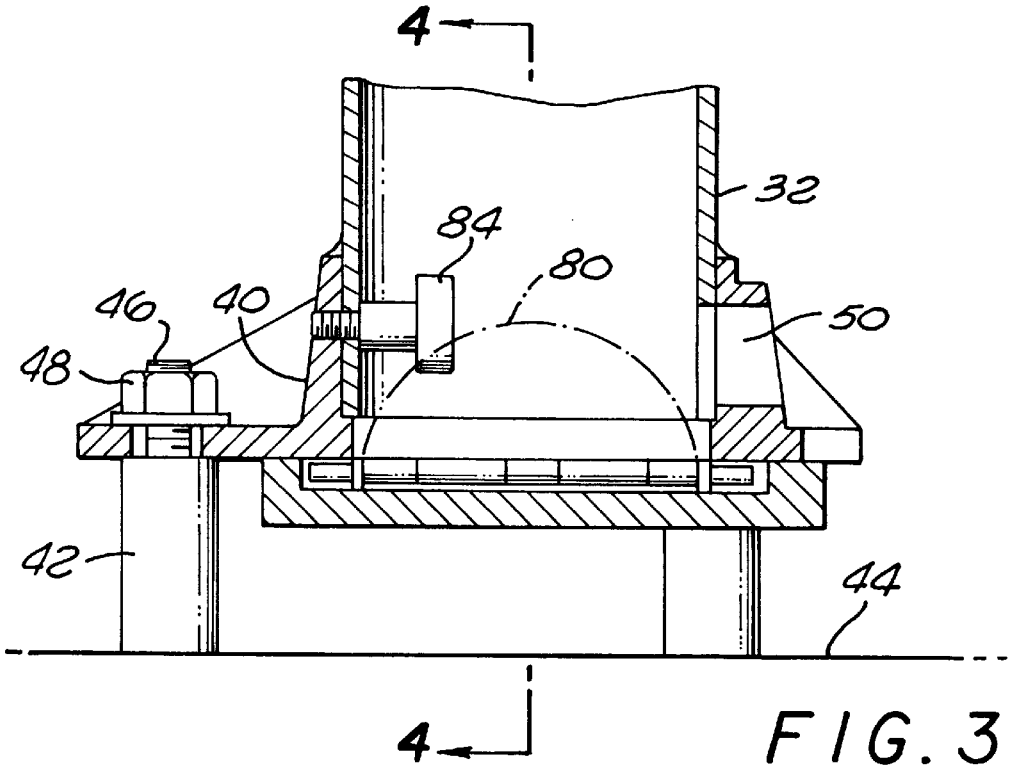
FIG. 3 is a cross section through the base and the bottom member illustrating certain details of the flapper valve therein.
Figure 5:
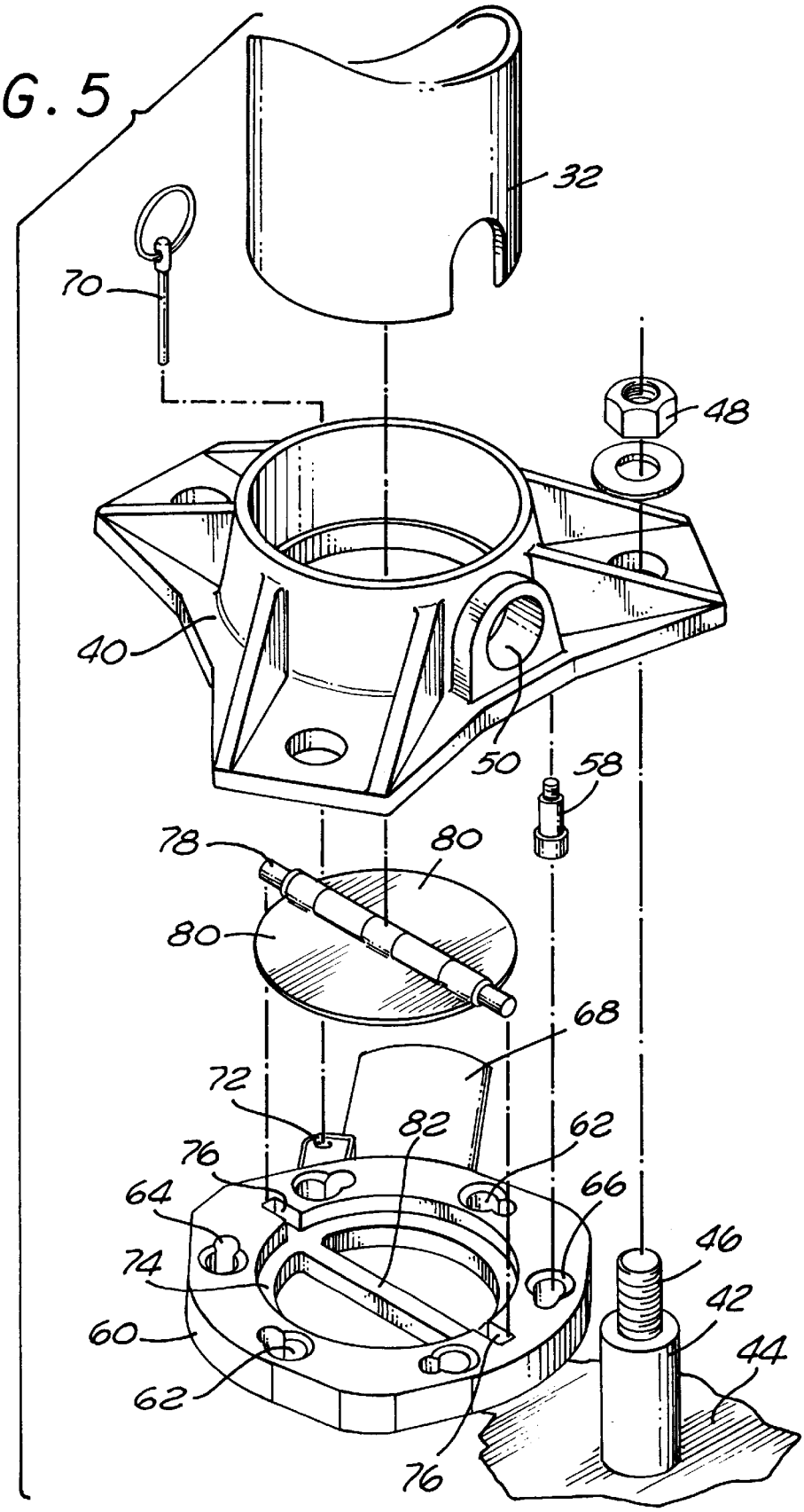
FIG. 5 is a perspective exploded view of the base and the bottom member illustrating further details of the assembly and the flapper valve therein.

Coupled to the bottom of tube 32 is a base 40 supported by spacers 42 off the bottom 44 of the pool 22, and fastened thereto by threaded studs and nuts 48, also visible in FIGS. 3 and 5. Alternatively, nuts and washers may be used above and below the base 40 in the three point pattern to provide adjustability for establishing and maintaining the vertical orientation of the vertical tubes. As visible in FIGS. 2, 3 and 5, the base 40 has a side port 50 to which a solenoid operated valve 52 is connected, the valve coupling and decoupling the bottom portion of the vertical tubing in the water display to the compressed air supply through line 54 by an electrical control signal on control lines 56 controlled by a solenoid driver, in turn controlled by a computer.

Figure 4:
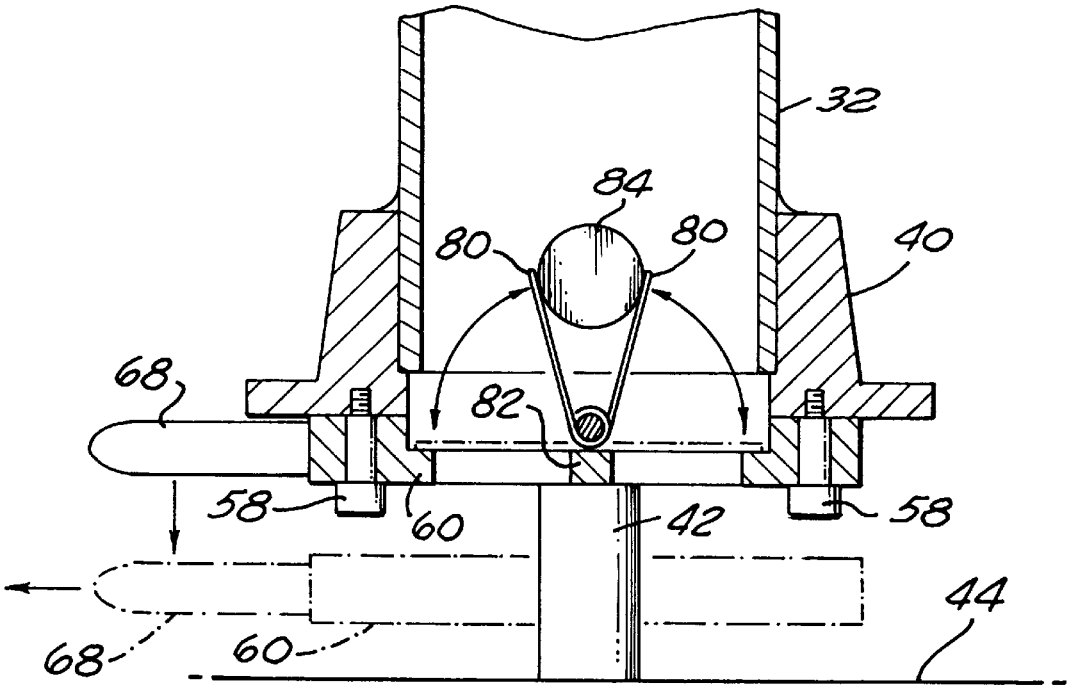
FIG. 4 is a cross section through the base and the bottom member taken along line 4—4 of FIG. 3.

Referring now particularly to FIGS. 3–5, the base 40 has a pattern of headed threaded pins 58 substantially permanently threaded into the bottom of the base 40. Also provided is a bottom member 60 having a hole pattern corresponding to the pattern of pins 58 on base 40 and of head diameter of the pins to allow the head of pins 58 to pass there through. The holes 62 have elongated regions 64 of a diameter slightly larger than the shank of pins 58 but smaller than the heads, and further include a conical countersink to aid in the alignment of the holes 62 with the head of pins 58. With this configuration, bottom member 60 may be placed under base 40, raised so that the head of pins 58 pass through holes 62, and then rotated somewhat so that the heads of pins 58 retain the bottom member in position by engagement with the bottom of the extended region 64 in the bottom member 60. To aid in the placement and removal of bottom member 60 from base 40, an integral handle 68 is provided for holding and manipulation of the bottom member, the bottom member fitting between the vertical studs 46 so as to be readily locked to the base 40 as described, or conveniently removed therefrom for cleaning and other servicing. To retain bottom member 60 in its assembled position with respect to the base 40, a retaining pin 70 (FIG. 5) is tethered to the base 40 and may be placed through a hole in the base 40 and through hole 72 in the bottom member to retain the bottom member at an angular position with respect to the base 40 corresponding to the locked position of the bottom member with respect to the base 40.

The bottom member 60 has a center circular relief area 74, with somewhat further radially extended slots 76 at diametrically opposed positions in the relief area. Placed within the relief is a flapper assembly in the form of a hinge pin 78 for the two halves 80 of the flapper, much like a door hinge. This flapper assembly merely rests within the reliefs 74 and 76 of the bottom member 60, with the integral center strut 82 providing additional support for the hinge pin 78. Thus, with the flapper assembly in position in the bottom member 60 and the bottom member locked to the base 40, a full flapper valve is formed (see also FIGS. 3 and 4), with the flapper assembly itself being trapped between bottom member 60 and base 40.

The operation of the system herein before described may be by way of a relatively continuous flow of water from the water supply (FIG. 2) through the controllable regulator controlled by a computer, or through one or more blasts of water caused by the high pressure air coupled to the bottom of the vertical tubing by the computer controlling the solenoid driver, in turn controlling the solenoid valve 52 to provide sufficient high pressure air to the bottom of the vertical tubing to provide a blast of water therefrom. When the flow of water through line 38 is turned off by the controllable regulator, the flapper 36 will close so that a subsequent blast of high pressure air into the bottom of the vertical tube will not cause the high pressure to be coupled back to the controllable regulator. After such an intermittent blast, however, the air pressure dissipates through the nozzle 20. Now the pressure difference between the inside of the tube and the water at the bottom of the pool 22 will cause the flapper to open, as illustrated in FIG. 4, to allow the vertical tubes to refill. Preferably, some provision is made to limit the flapper opening to avoid the possibility that the flapper will hang up in the open position or that one of the flapper halves will not inadvertently merely pass the vertical position and fall over on the other flapper half. This may be done, by way of example, by the use of a stepped pin 84 (see FIG. 4) which limits the upward movement of the flapper halves 80 to an acute angle, assuring that gravity will return the flapper halves to the horizontal position when the flow of water refilling the vertical tubes has substantially stopped.

In the operation of the system of the present invention just described, it is preferable to impose certain limits on the operation thereof to extend the life of the system. By way of example, sufficient time should be allowed between air powered blasts of water from the display to allow the vertical tubes to substantially refill. Otherwise the flapper valve in the bottom member 60, being open for refilling when the next blast of high pressure air enters the bottom of the vertical tubes, will slam shut, with the potential of accelerated wear or failure. Further, since the opening in nozzle 20 is typically of a diameter of only a fraction of the inner diameter of the vertical tubes, the water in the partially filled vertical tubes will freely accelerate upward to the nozzle, creating an extraordinary water hammer effect when the water-air interface reaches the nozzle. For similar reasons, it is also desired to have flapper 36 closed before the high pressure air is turned on to prevent any back flow to the controllable regulator and to prevent the flapper from slamming closed. These time limitations, however, are relatively short, and can readily be determined and included as limitations in the computer software without really detracting from the ultimate display achieved.

In terms of construction, in the preferred embodiment the flapper valve 34 is a brass flapper valve, the base 40 and bottom member 60 are cast bronze members, and the flapper assembly therein is a stainless steel assembly. The vertical tubes, as well as other tubes in the system, may be brass, copper or other metallic materials not readily subject to corrosion, or alternatively, thick-walled PVC tubing using threaded joints or solvent welded joints. Similarly, nozzle 20 may be PVC, brass, spun stainless steel or such other materials as may be convenient. In the preferred embodiment, tube section 32 is a relatively short copper tube section soldered to tee 30 and base 40, with the upper tube 28 being PVC threaded into tee 30.

Figure 6:
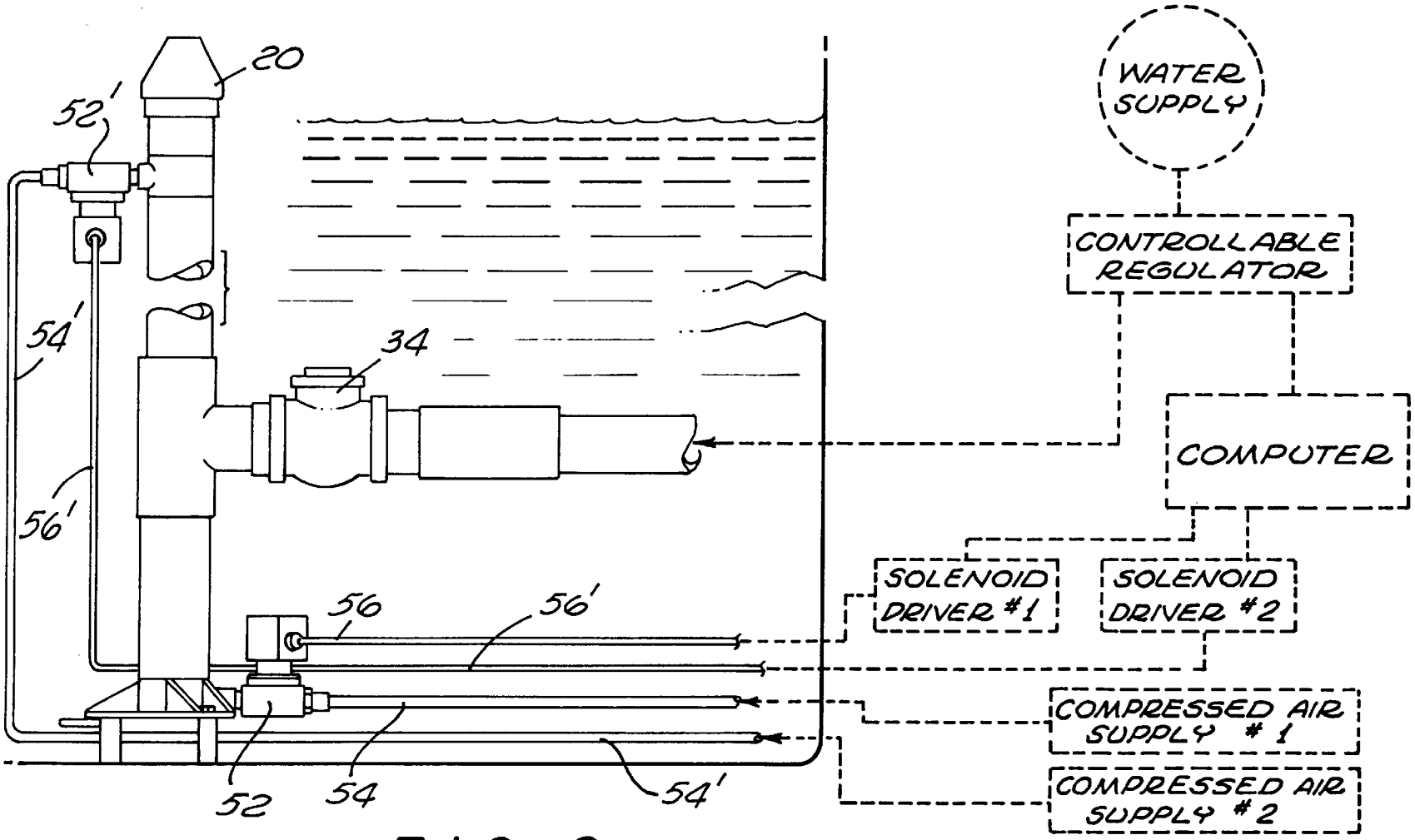
FIG. 6 illustrates an alternate embodiment of the water displays of the present invention and the control therefor.

Finally, one further embodiment is illustrated in FIG. 6. In particular, to expel water therefrom under air power, it is common to inject enough air at a sufficiently high pressure to relatively rapidly eject from the nozzle all water other than that which falls through the pressurized air as the air volume increases. As such, one can use air at a lower pressure, injected at a position higher in the vertical tubes, to eject a smaller amount of water and to throw the same to a lower height. Accordingly, as shown in FIG. 6, an additional solenoid valve 52' operating from a second compressed air supply of a lower pressure than the first compressed air supply is controlled to controllably eject a much smaller blob of water, typically to a much lower height, even lower than is readily achievable using the controlled flow of water through the controllable regulator. Obviously, while only two different pressures and two points of injection of pressurized air are shown in FIG. 6, any number greater than two may also be used. Further, the second compressed air supply, being typically of lower pressure than the first compressed air supply, may in fact be the combination of the first compressed air supply and a pressure regulator therefrom for reducing the pressure of air from the first compressed air supply to the second solenoid valve 52. Finally, controllable regulators controlled by the computer could also be used in conjunction with any or all compressed air supplies, though this is not preferred.

Thus, while the present invention has been disclosed and described with respect to certain preferred embodiments thereof, it will be understood by those skilled in the art that various changes in form and detail may be made therein without departing from the spirit and scope thereof.

What is claimed:

1. A water display comprising:

a tube structure having a nozzle at the top thereof for placing in a pool of water;

a controllable source of water coupled to the tube structure to controllably force water into the tube structure to expel water from the nozzle;

a controllable source of air under pressure coupled to the tube structure; and, a first valve coupled to the tube structure, the first valve opening in response to differential pressure to allow water flow into the tube structure from a surrounding pool of water and closing to prevent the flow of water from the tube structure to a surrounding pool of water.

2. The water display of claim 1 further comprised of a second valve between the controllable source of water under pressure and the tube structure, the second valve opening in response to differential pressure to allow water flow into the tube structure from the source of water under pressure and closing to prevent the flow of water from the tube structure to the source of water under pressure.

3. The water display of claim 2 wherein the first and second valves are flapper valves.

4. The water display of claim 1 wherein the first valve is adjacent the bottom of the tube structure.

5. The water display of claim 1 further comprised of a computer, the computer controlling the controllable source of water under pressure and the controllable source of air under pressure.

6. The water display of claim 1 wherein the controllable source of water under pressure comprises a supply of water under pressure and a controllable regulator controlling the output of the supply of water under pressure.

7. The water display of claim 1 wherein the controllable source of air under pressure comprises a supply of air under pressure and a solenoid valve controlling the output of the supply of air under pressure.

8. The water display of claim 7 wherein the controllable source of air under pressure is coupled through an air line to the tube structure adjacent to the bottom thereof, and the solenoid valve is coupled in the air line adjacent the tube structure.

9. A water display comprising:

a pool of water;

a tube structure supported in the pool of water and having a nozzle at the top thereof adjacent the top of the pool;

a controllable source of water under pressure coupled to the tube structure to controllably force water into the tube structure and expel water from the nozzle;

a controllable source of air under pressure coupled to the tube structure to controllably force air into the tube structure to expel water from the tube structure through the nozzle; and, a first valve coupled to the tube structure, the first valve opening in response to differential pressure to allow water flow into the tube structure from a surrounding pool of water and closing to prevent the flow of water from the tube structure to a surrounding pool of water.

10. The water display of claim 9 further comprised of a second valve between the controllable source of water under pressure and the tube structure, the second valve opening in response to differential pressure to allow water flow into the tube structure from the source of water under pressure and closing to prevent the flow of water from the tube structure to the source of water under pressure.

11. The water display of claim 10 wherein the first and second valves are flapper valves.

12. The water display of claim 9 wherein the first valve is adjacent the bottom of the tube structure.

13. The water display of claim 9 further comprised of a computer, the computer controlling the controllable source of water under pressure and the controllable source of air under pressure.

14. The water display of claim 13 wherein the controllable source of water under pressure comprises a supply of water under pressure and a controllable regulator controlling the output of the supply of water under pressure.

15. The water display of claim 14 wherein the controllable source of air under pressure comprises a supply of air under pressure and a solenoid valve controlling the output of the supply of air under pressure.

16. The water display of claim 15 wherein the controllable source of air under pressure is coupled through an air line to the tube structure adjacent the bottom thereof, and the solenoid valve is coupled in the air line adjacent the tube structure.

17. A water display comprising:

a pool of water;

a tube structure supported in the pool of water and having a nozzle at the top thereof adjacent the top of the pool;

a supply of water under pressure and a controllable regulator controlling the output of the supply of water under pressure coupled to the tube structure adjacent the bottom thereof to controllably force water into the tube structure and expel water from the nozzle;

a supply of air under pressure and a solenoid valve controlling the output of the supply of air under pressure coupled to the tube structure adjacent the bottom thereof to controllably force air into the tube structure to expel water from the tube structure through the nozzle; and, a first valve coupled to the tube structure, the first valve opening in response to differential pressure to allow water flow into the tube structure from a surrounding pool of water and closing to prevent the flow of water from the tube structure to a surrounding pool of water.

18. The water display of claim 17 further comprised of a second valve between the controllable regulator and the tube structure, the second valve opening in response to differential pressure to allow water flow into the tube structure from the controllable regulator and closing to prevent the flow of water from the tube structure to the controllable regulator.

19. The water display of claim 18 wherein the first and second valves are flapper valves.

20. The water display of claim 17 further comprised of a computer, the computer controlling the controllable regulator and the solenoid valve.

21. A water display comprising:

a pool of water;

an enclosure supported in the pool of water and having at least one opening adjacent the top thereof;

a controllable source of air under pressure coupled to the enclosure to controllably force air into the enclosure to expel water from the enclosure through the nozzle; and, a valve coupled to the enclosure, the valve opening in response to differential pressure to allow water flow into the enclosure from a surrounding pool of water and closing to prevent the flow of water from the enclosure to a surrounding pool of water, the valve having;

a valve mounting member coupled to the enclosure;

a base member, the base member and the valve mounting member having cooperatively disposed complimentary engaging members for retaining the base member and the valve mounting member together when the complementary engaging members are in a first relative position, and to allow the free separation of the base member and the valve mounting member when the complementary engaging members are in a second relative position; and, a flapper between the base member and the valve mounting member, the base member and the valve mounting member having a cooperatively disposed opening there through to provide a water flow path between the pool and the interior cavity of the enclosure, the valve flapper responding to differential pressure thereon to move to a valve open position to allow water flow from the pool into the interior cavity of the enclosure, and to move to a valve closed position to prevent water flow from the interior cavity of the enclosure back into the pool.

22. The water display of claim 21 wherein the complementary engaging members comprise headed projections on one of the base member and valve mounting member and slots in the other of the base member and valve mounting member, the slots being enlarged adjacent one end thereof so that the head of the protrusions may pass there through, the slots interfering with the passage of the heads of the protrusions there through adjacent the other end of the slots.

23. The water display of claim 22 wherein the base member is rotated with respect to the valve mounting member to go between the first and second relative positions.

24. The water display of claim 23 further comprised of a removable locking member retaining the base member and the valve mounting member in the first relative positions.

25. The water display of claim 21 wherein the flapper is entrapped between the base member and the valve member.

26. The water display of claim 25 wherein the flapper is comprised of first and second flapper members on a common axle member, the axle member being entrapped between the base member and the valve member.

27. The water display of claim 26 wherein the valve mounting member includes flapper stops limiting the amount of opening of each flapper member.

28. The water display of claim 27 wherein the flapper is encouraged toward the closed position by gravity.

29. The water display of claim 21 wherein the valve mounting member is adjacent the bottom of the enclosure.

30. A flapper valve for automatic filling of the interior cavity of an enclosure forming a part of a water display in a pool of water, the flapper valve being below the surface of the water, comprising:

a valve mounting member coupled to the enclosure;

a base member, the base member and the valve mounting member having cooperatively disposed complimentary engaging members for retaining the base member and the valve mounting member together when the complementary engaging members are in a first relative position, and to allow the free separation of the base member and the valve mounting member when the complementary engaging members are in a second relative position; and, a flapper between the base member and the valve mounting member, the base member and the valve mounting member having a cooperatively disposed opening there through to provide a water flow path between the pool and the interior cavity of the enclosure, the valve flapper responding to differential pressure thereon to move to a valve open position to allow water flow from the pool into the interior cavity of the enclosure, and to move to a valve closed position to prevent water flow from the interior cavity of the enclosure back into the pool;

the valve opening in response to differential pressure to allow water flow into the enclosure from a surrounding pool of water and closing to prevent the flow of water from the enclosure to a surrounding pool of water.

31. The flapper valve of claim 30 wherein the complementary engaging members comprise headed projections on one of the base member and valve mounting member and slots in the other of the base member and valve mounting member, the slots being enlarged adjacent one end thereof so that the head of the protrusion may pass there through, the slots interfering with the passage of the heads of the protrusions there through adjacent the other end of the slots.

32. The flapper valve of claim 31 wherein the base member is rotated with respect to the valve mounting member to go between the first and second relative positions.

33. The flapper valve of claim 32 further comprised of a removable locking member retaining the base member and the valve mounting member in the first relative positions.

34. The flapper valve of claim 30 wherein the flapper is entrapped between the base member and the valve member.

35. The flapper valve of claim 34 wherein the flapper is comprised of first and second flapper members on a common axle member, the axle member being entrapped between the base member and the valve member.

36. The flapper valve of claim 35 wherein the valve mounting member includes flapper stops limiting the amount of opening of each flapper member.

37. The flapper valve of claim 36 wherein the flapper is encouraged toward the closed position by gravity.

38. The flapper valve of claim 30 wherein the valve mounting member is adjacent the bottom of the enclosure.

* * * * *